US007520629B2

(12) United States Patent
Johnson et al.

(10) Patent No.: US 7,520,629 B2
(45) Date of Patent: Apr. 21, 2009

(54) UNDERWATER LED FLASHLIGHT SYSTEM

(76) Inventors: John D. Johnson, 136 E. Daniels Rd., Palatine, IL (US) 60067; Daniel Friedel, 125 W. North Ave., Lombard, IL (US) 60148

( * ) Notice: Subject to any disclaimer, the term of this patent is extended or adjusted under 35 U.S.C. 154(b) by 767 days.

(21) Appl. No.: 11/029,680

(22) Filed: Jan. 5, 2005

(65) Prior Publication Data

US 2008/0130268 A1 Jun. 5, 2008

(51) Int. Cl.
*F21V 33/00* (2006.01)

(52) U.S. Cl. ..... 362/103; 362/253; 362/191

(58) Field of Classification Search ..... 362/103, 362/253, 191, 190
See application file for complete search history.

(56) References Cited

U.S. PATENT DOCUMENTS 3,112,889 A * 12/1963 Marmo et al. ..... 362/103
5,345,368 A * 9/1994 Huff ..... 362/103
6,988,814 B1 * 1/2006 Correa ..... 362/109
2001/0048596 A1 * 12/2001 Kerr ..... 362/110
2002/0109981 A1 * 8/2002 Amici ..... 362/103

* cited by examiner

*Primary Examiner*—Laura Tso
(74) *Attorney, Agent, or Firm*—Ryndak & Suri LLP

(57) ABSTRACT

A flashlight is provided comprising a LED illumination source, a power source electrically coupled to said LED illumination source, and a solid body encapsulating the power source and at least a portion of the LED illumination source. The invention further includes an underwater illumination system comprising a glove having an interior, an inner surface, and an outer surface, and an underwater flashlight comprising a LED illumination source, a power source electrically coupled to the LED illumination source, a solid body encapsulating the power source and at least a portion of the LED illumination source, and a securing member for connecting the underwater flashlight to said glove. A method for making an underwater, pressure-resistant LED flashlight is provided for making an encapsulating solid body for the elements providing illumination.

4 Claims, 2 Drawing Sheets

UNDERWATER LED FLASHLIGHT SYSTEM

FIELD OF THE INVENTION

The present invention relates generally to flashlights, and more specifically to a solid, pressure-resistant LED flashlight which is attachable over a user's hand, and to methods of making a solid, pressure-resistant LED flashlight.

BACKGROUND OF THE INVENTION

Numerous underwater flashlight devices are known for SCUBA diving to provide illumination for the diver when diving at depths where natural lighting is limited. These known devices, however, suffer from numerous deficiencies. For example, such devices are not suitable for deeper dives because they are not able to handle the substantial pressures at such depths without being deformed and damaged. In particular, such underwater flashlights, while claiming to be "waterproof," cannot withstand substantial pressures because their housings, while sealed, still contain air pockets which enable the device to be crushed at the substantial pressures associated with deep waters. Also, it is advantageous for a SCUBA diver to have his hands free to move objects, other equipment, or for movement in the midst of a dive. However, known underwater illumination devices require the user to use at least one of his or her free hands to carry the device.

Additionally, numerous other out-of-water activities require user-directed illumination which could benefit from hands-free operation. For example, one fixing a vehicle could benefit from having a light source directed on the component to be fixed while having his or her hands free for holding another tool or for other activity. Further, public safety personnel, for example police officers, could use the light to shine in vehicles while maintaining their hands free for use as needed during typical traffic stops. Also, firemen would find these types of flashlights helpful in carrying out lifesaving procedures with their hands free. Therefore, there is a need for a more waterproof, pressure-resistant, and easy to use illumination source which enables hands-free operation of the device.

SUMMARY OF THE INVENTION

In accordance with the present invention, there is provided a flashlight comprising a LED illumination source, a power source electrically coupled to the LED illumination source, and a solid body encapsulating the power source and at least a portion of the LED illumination source. Preferably, the solid body includes a bottom portion which has a substantially contoured shape so that the flashlight may be mounted on a top portion of a user's hand. Thus, the contour of the bottom portion may substantially follow the contour of the top portion of a human hand, for example. The power source may be any suitable portable DC power source, including but not limited to an inductively rechargeable power source.

The solid body is substantially filled with an encapsulation material which encapsulates the power source and at least a portion of the LED illumination source. The encapsulation material may be any suitable polymer, wax, polyester resin, epoxy resin, or silicone material known in the art. Alternatively, the encapsulation material may be any other suitable material, which, in its substantially solid form, is relatively inert and is particularly pressure-resistant and usable at depths where known devices would easily fail. A particularly suitable encapsulation material for the invention is a flexible urethane rubber material. Optionally, the solid body includes a plastic outer shell which encompasses at least a portion of the solid body, and preferably substantially encompasses the solid body with the exception of a portion of the front face of the device so that light may be emitted from the flashlight body. The shell may further include a structure for supporting the power source and bezel assembly within the interior of the shell.

In accordance with another aspect of the present invention, the flashlight further includes a securing member which enables the flashlight device to be directly or indirectly secured to another object or member, such as the top portion of a hand of a user. Suitable securing members for use in accordance with the invention include magnets, straps, snap fittings, clips, adhesives, and combinations thereof, or any other suitable device known in the art for attaching one device to another object or member.

In one particular construction, the securing member comprises a bottom sled and a mounting member. The bottom sled and the mounting member are shaped and configured to releasably mate with one another while the flashlight also releasably attaches to the mounting member. In one embodiment, the bottom sled includes at least one embossment that mates with a corresponding aperture in the mounting member, and the mounting member includes at least two clip members, and preferably three clip members, for maintaining the flashlight on a top portion of the mounting member and within the clip members. Typically, the flashlight body, bottom sled, and mounting member have the same or substantially similar contour on the bottom surfaces thereof such that each of the components is contoured to follow the hand of a user.

In another aspect of the present invention, there is provided an underwater illumination system comprising a glove having an interior, an inner surface, and an outer surface, and an underwater flashlight. The glove is typically a neoprene dive glove for underwater use, but may be any other suitable glove, mitten, or mitt. The underwater flashlight of the system typically comprises a LED illumination source, a power source electrically coupled to the LED illumination source, and a solid body encapsulating the power source and at least a portion of the LED illumination source, wherein the solid body includes a bottom portion which has a substantially contoured shape so that the flashlight may be mounted over a top portion of a user's hand. The system further includes a securing member for connecting, and preferably detachably connecting, the underwater flashlight to the glove.

In one embodiment of the underwater illumination system, the securing member comprises a bottom sled and a mounting member and an intervening member, wherein the bottom sled and the mounting member are releasably engageable into a mounted position wherein the bottom sled and the mounting member are in a fixed position relative to the glove and an intervening portion of the glove is maintained between the bottom sled and the mounting member. In the mounted position, the bottom sled is disposed within the interior of the glove and abuts a portion of the inner surface of the glove and the mounting member is disposed over a portion of the outer surface of the glove and over the glove and the bottom sled.

In one embodiment, the bottom sled includes at least one embossment which mates with a corresponding aperture in the mounting member and a portion of the glove is maintained between the bottom sled and the mounting member when the bottom sled and the mounting member are mated with one another.

In accordance with another aspect of the present invention, the flashlight is detachably connected to the mounting member. In one embodiment, the mounting member includes at least two clip members, and preferably three clip members, for maintaining the flashlight on a top portion of the mounting member and between the clip members. Alternatively, the flashlight may be permanently or detachably connected to the mounting member by any suitable structure.

Further alternatively, the flashlight may be permanently or detachably attached to a glove, other object, or body part through the use of magnets, straps, sewing, elastic materials, ties, and combinations thereof, or by any suitable structure known in the art.

In accordance with yet another aspect of the present invention, there is provided a method of making an underwater LED flashlight comprising:

providing a LED illumination light source;

electrically connecting the LED illumination light source to a power source;

forming a flashlight precursor body by encapsulating the power source and at least a portion of the LED illumination source within an encapsulation material; and curing said encapsulation material to form a solid flashlight body.

In one embodiment, the step of forming a flashlight precursor body further comprises providing a housing having an internal cavity, disposing at least a portion of the LED illumination source and power source within the internal cavity, and injecting the encapsulation material within the internal cavity of the housing. Optionally, the housing may include a structure for supporting at least a portion of the LED illumination source and the power source within the interior of the housing.

In another embodiment, the step of forming a flashlight precursor body further comprises placing the LED illumination source and power source within a mold having a cavity, adding an encapsulation material to the cavity of the mold, and after the step of curing, removing the mold from the formed solid flashlight body.

Other advantages and features of the invention will become apparent from the following description and from reference to the drawings.

DETAILED DESCRIPTION OF THE PREFERRED EMBODIMENTS

Figure 1:
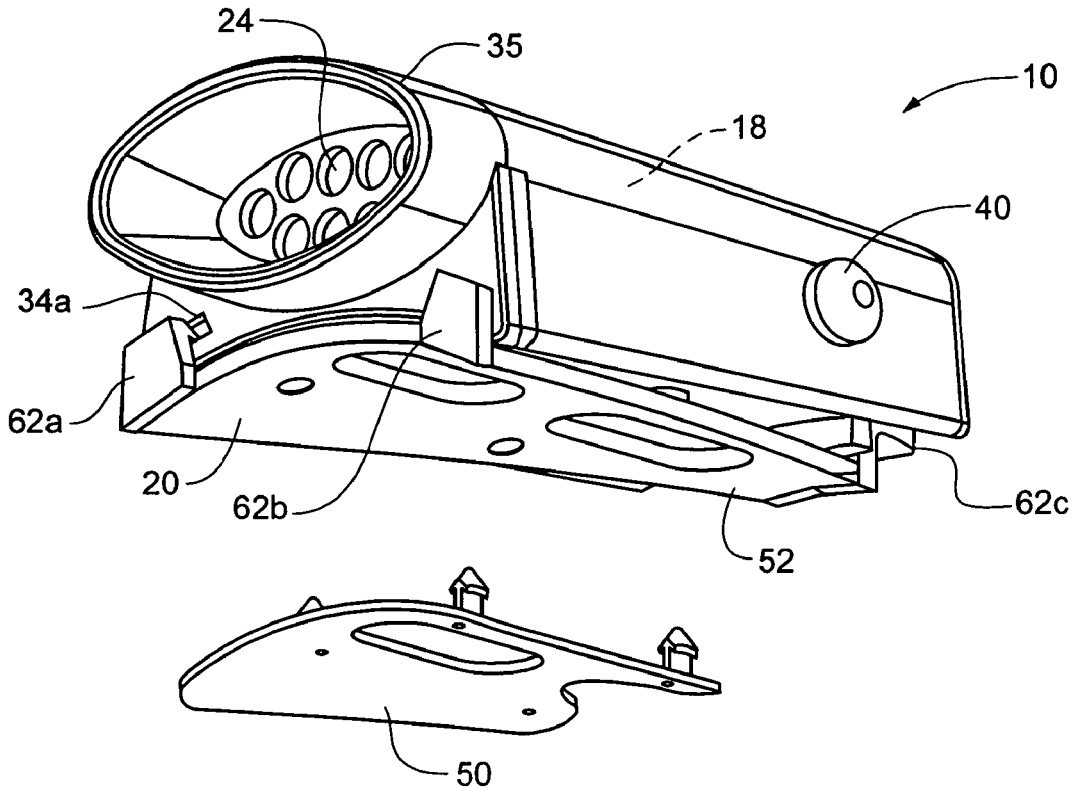
FIG. 1 is a partially exploded view of the LED flashlight in accordance with the present invention.

While this invention is susceptible of embodiment in many different forms, there is shown in the drawings and described in detail herein, several specific embodiments with the understanding that the present disclosure is to be considered as exemplary of the principles of the invention and is not intended to limit the invention to the embodiments illustrated.

The present invention is directed to a substantially solid, waterproof LED flashlight which is easily detachably secured to a user's outer clothing, such as a glove, for example. The invention is of particular use for underwater divers who desire a powerful illumination source while also maintaining their hands free for other uses. In one construction, the LED flashlight is detachably connected to at least one of a SCUBA diver's gloves. The solid body construction of the inventive flashlight enables the flashlight to be used at depths that would normally destroy and/or deform known underwater flashlights.

Figure 2:
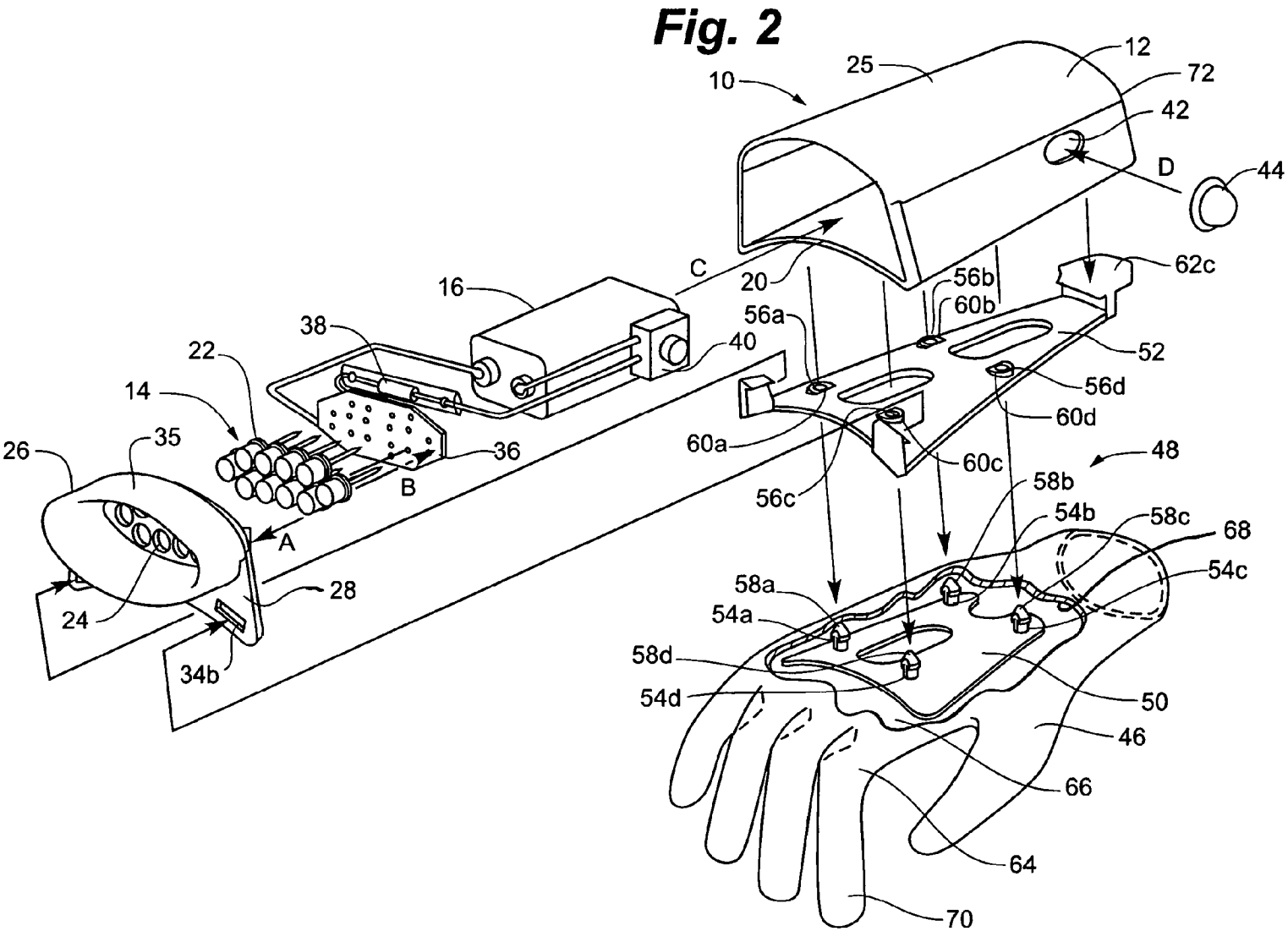
FIG. 2 is a perspective view of an underwater LED flashlight system in accordance with the present invention illustrating a LED flashlight and its components, a securing member having a mounting member and a bottom sled in accordance with the present invention, and an exemplary diver's glove.

Now referring to the drawings, as shown in FIGS. 1-2, LED flashlight 10 includes body 12, LED illumination source 14, and power source 16. Flashlight body 12 is substantially solid and typically includes a hard outer shell housing 25 constructed from any suitable material, such as plastic. Power source 16 and at least a portion of LED illumination source 14 are imbedded within an encapsulation material 18 which will render the flashlight particularly resistant to underwater deformation at depths of greater than 200 feet below the surface or more, for example. Typically, a bottom surface 20 of flashlight body 12 has contour shape that is substantially similar to the contour of a top portion of a user's hand. As such, the flashlight follows the contour of the user's hand when detachably secured thereto, as will be discussed in further detail below.

As shown in FIG. 2, LED illumination source 14 comprises one or more light emitting diode lamps, and preferably a plurality of LED lamps 22, to provide a powerful illumination source for the user. The LED lamps are typically housed through corresponding apertures 24 in a bezel assembly 26, and preferably a chrome bezel assembly, which is disposed at the front of flashlight body 12. The chrome bezel assembly aids in directing and focusing light in front of the LED flashlight. At least a portion of bezel assembly 26 and lamps 22 are encompassed within flashlight body 12 by encapsulation material 18 so as to render bezel assembly 26 and lamps 22 particularly resistant to deformation. A portion of LED lamps 22 may extend through apertures 24 such that a portion of each lamp 22 is external of flashlight body 12, but preferably LED lamps 22 are maintained within an interior of flashlight body 12 and bezel assembly 26 so as to not extend externally beyond flashlight body 12 and bezel assembly 26, as shown in FIG. 1.

Additionally, bezel assembly 26 may include a clip portion 28 extending downwardly from bezel assembly 26. Clip portion 28 preferably includes a pair of apertures 34*a*, 34*b*. Because bezel assembly is substantially encapsulated by encapsulation material 18, it is understood that bezel assembly 26 does not require a lens to cover LED illumination source 14. Optionally, bezel 26 includes a dome-shaped portion 35 which outwardly with respect to LED lamps and encircles LED lamps 22.

Power source 16 is electrically coupled to LED lamps 22 of bezel assembly to power LED illumination source 14. In particular, power source 16 may include one or more batteries, and preferably rechargeable DC batteries, connected in parallel or in series or a combination thereof. In one embodiment, flashlight 10 is powered and is continuously rechargeable by induction. By allowing the user to continuously recharge and power the device through mechanical motion, the device is particularly useful in deep dives because the user will not worry about the device failing when needed. Alternatively, any other suitable portable DC power source known in the art may be utilized.

In one embodiment, a portable charger may be provided to recharge the power source. For example, the charger may include a transformer plug which recharges the DC power source within the body of the device. Typically, one end of the power source includes a charging jack having a conductive sleeve for receiving the plug of a charger. Alternatively, the charger may be a form fitting cradle with power cord with suitable conductive components for recharging the power source.

Typically, as shown in FIG. 2, lamps 22 are disposed through apertures 24 of bezel assembly 26 and are electrically connected to power source 16 through a circuit board 36 having a plurality of apertures and a voltage drop resistor 38. Further, power source 16 is typically electrically connected to a switching mechanism 40 for selectively powering LED flashlight 14. Switching mechanism 40 may be any suitable structure known in the art for turning the illumination source from an on position to an off position and vice-versa.

In one embodiment, the switching mechanism is a sliding switch mechanism which enables the user to selectively turn the device on and off by sliding a tab in a particular direction.

In another embodiment, switching mechanism 40 is a pressure-sensitive switch which enables the user to selectively turn the device on and off by pressing down on switching mechanism 40. Typically, flashlight body 12 includes an aperture 42 for accepting switch mechanism 40. A plastic or rubber cover 44 member may be inserted through aperture 42 of flashlight body 12 to prevent water or any other foreign substance from entering body 12.

Encapsulation material 18 may be any known polymer, wax, polyester resin, epoxy resin, or silicone material. Alternatively, encapsulation material 18 may be any other suitable material, which, in its substantially solid form, is particularly pressure-resistant at depths where known devices would easily fail. A particularly suitable encapsulation material for the invention is flexible urethane rubber.

LED flashlight 10 may be directly or indirectly (through the use of an intermediate device) secured to any object or body part of a user by any suitable structure, such as those known in the art. Examples of such suitable structures include a magnet, hook and loop fasteners, clips, straps, ties, elastic members, and combinations thereof.

In one particular construction of the present invention, LED flashlight 10 is adapted to be detachably connected to a typical SCUBA diver's glove 46 by a securing member 48. Securing member 48 comprises a bottom sled 50 and a mounting member 52 which releasably mate with one another. While mounting member 52 and sled 50 are illustrated as separate components from flashlight body 12, it is understood that mounting member 52 and sled 50 or any other suitable structure for mounting flashlight body 12 on a body part or object may be integral with flashlight body 52 or may comprise one, two, or more components as desired. Typically, bottom sled 50 and mounting member 52 include a bottom surface having a substantially contoured shape, which is the same shape or substantially similar to the contoured bottom surface shape of the flashlight body. Each of the bottom sled 50 and mounting member 52 may include one or more voids to enable each of bottom sled 50 and mounting member 52 to flex more easily.

In one embodiment, bottom sled 50 includes at least one embossment, for example embossments 54*a*, 54*b*, 54*c*, 54*d*, each of which mate with a corresponding aperture in the mounting member, for example apertures 56*a*, 56*b*, 56*c*, 56*d* of mounting member 52. In one embodiment, embossments 54*a-d* each include a tapered tip portion 58*a-d* for improved mating with apertures 56*a-d*. Moreover, apertures 56*a-d* typically comprise strengthening bored embossments 60*a-d*, each having a interior bore for accepting tapered embossments 58*a-d*.

As shown in FIG. 2, in one embodiment, mounting member 40 includes at least two clip members, and preferably three clip members 62*a*, 62*b*, 62*c*, for maintaining flashlight body 12 on a top portion 64 of mounting member 52 and between clip members 62*a-c*.

Glove 46, to which flashlight 10 is connected, is typically a neoprene dive glove for underwater use having an interior 66, an inner surface 68, and an outer surface 70. Alternatively, flashlight 10 may be permanently or detachably connected to any other suitable glove, mitten, or mitt by any suitable structure.

As shown in FIG. 2, the bulbous end of LED lamps 22 may be inserted through apertures 24 in bezel assembly 26 in the direction shown by arrow A. Thereafter the opposite ends of lamps 22 may be inserted through apertures in circuit board 36 in the direction shown by arrow B. Resistor 38 is electrically connected to circuit board 36 on one end thereof and electrically connected to switching mechanism 40 on an opposite end thereof. Once assembled, bezel assembly 26, power source 16, resistor, switching mechanism 40 are positioned within a housing 25 in the direction shown by arrow C. A cover 44 for switching mechanism 40 is preferably disposed within aperture 42 of flashlight housing as shown by arrow D. Thereafter, housing 25 is filled with encapsulation material 18 (not shown) and allowed to cure as described in detail below.

Alternatively, bezel assembly 26, power source 16, resistor, switching mechanism 40 may be disposed within a mold and encapsulation material 18 is added to the mold. In this embodiment, the cured encapsulation material may be the housing itself.

Also shown in FIG. 2, once formed, flashlight 10 may be secured to a glove 46, which is an exemplary SCUBA glove, as follows. Bottom sled 50 is placed within interior 66 of glove 46 such that bottom sled 50 abuts a portion of inner surface 68 of glove 46. Mounting member 52 is placed over bottom sled 50 over outer surface 70 of glove 46. Embossments 54*a-d* of bottom sled 50 cooperate with apertures 56*a-d* of mounting member 52 by pressing mounting member downward in the direction shown by arrow D of FIG. 2. When mated, bottom sled 50 and mounting member 52 are in a mounted position wherein bottom sled 50 and mounting member 52 are in a fixed position relative to glove 46. Preferably, an interviewing portion of glove 46 is maintained between bottom sled 50 and mounting member 52, and is shaped and configured to retain the bottom sled 50 within glove 46.

Flashlight 10 may then be detachably connected to the mounting member 52 by inserting flashlight 10 such that it is maintained over a top surface of mounting member 52 by clip members 62*a-c*. For example, apertures 34*a*, 34*b* of clip portion 28 of bezel assembly 26 are configured to mate with clip members 62*a*, 62*b* of mounting member 52 and a back portion 72 of flashlight body 12 may be maintained and grasped by clip member 62*c*.

Alternatively, any other suitable structure known in the art for retaining flashlight body 12 to or within mounting member 52 may be used. Once affixed, the diver is provided a high intensity light source, which is resistant to the stresses of several atmospheres of water pressure, and which can be used while remaining relatively hands-free. It is understood the specific orientation of the flashlight LED illumination source 14 may be adjustable relative to the bottom sled 50, and may require manual adjustment as needed.

It is contemplated that although the example of affixing the LED flashlight of the present invention to a typical SCUBA divers glove is shown, the invention is not limited to a SCUBA glove having a flashlight connected thereto, but another glove or hand covering known in the art may be used. Additionally, while the use of the flashlight of the present invention in an underwater environment is presented as a preferred use of the invention as discussed herein, the flashlight is not limited to use in such an environment. The flashlight also serves as a durable, waterproof flashlight for any out-of-water use where the user desires a user-directed illumination source that enables the user to maintain the free use of his or her hands. Further, the inventive LED flashlight may also be detachably connected to a stationary object, such as the hood of a vehicle, to provide illumination to a user fixing a vehicle, for example.

A utility ring (not shown) may be added to the flashlight body to enable the user to detachably connect flashlight 10 to the diver's straps or other equipment when not in use. For example, a diver using the flashlight according to this invention may detachably connect flashlight to the user's buoyancy compensator.

The present invention further includes a method of making an underwater LED flashlight. In the method of the invention, an LED illumination source, typically comprising one or more LED lamps, is provided, preferably by inserting the one or more lamps through corresponding apertures in a bezel assembly. The one or more lamps are electrically connected to a power source by any suitable method known in the art. The power source may be one or more rechargeable batteries connected in series or in parallel, and preferably includes a switching mechanism electrically connected thereto. A circuit board having a resistor is typically disposed and electrically connected between the LED illumination source, preferably a plurality of lamps, and the power source. A switching mechanism is also preferably provided to selectively power the power source.

In one embodiment, at least a portion of the bezel assembly, the power source, and switching mechanism, if any, are disposed within a housing and supported by any suitable structure. Typically, the housing is placed within a mold or other suitable structure to ensure the housing remains stabilized during the manufacturing process and to ensure the final product is of the desired shape. Preferably, the housing is of a solid plastic shell that has a substantially contoured shape on at least a bottom portion thereof. Thereafter, the method comprises substantially filling housing with an encapsulation material to form a flashlight body precursor. Next, the method includes curing the encapsulation material so as to form a substantially solid flashlight body in which the encapsulation material essentially isolates the elements within the housing. Moreover, the encapsulation material has sufficient integrity so as to enable it to support the housing from collapse or deformation, even at the high pressures encountered during deep dives.

The encapsulation material may be any known polymer, wax, polyester resin, epoxy resin, or silicone material. Alternatively, the encapsulation material may be any other suitable material, which, in its solid form, is particularly pressure-resistant and usable at depths where known devices would normally fail. A particularly suitable encapsulation material for the invention is flexible urethane rubber.

Alternatively, the plastic housing need not be used and the power source and bezel assembly may be supported and maintained within a mold. Thereafter, the encapsulation material may be added to the mold, allowed to cure, and the formed device or mold may be removed to yield the final product. In this embodiment, the cured encapsulation material may be the housing itself. Further, the encapsulation material may be any known polymer, wax, polyester resin, epoxy resin, or silicone material, and preferably is flexible urethane rubber.

Further, any of the above methods of manufacture may further include forming a mounting member, which releasably retains the solid flashlight body within the mounting member, and a bottom sled, which releasably attaches to the mounting member by any suitable method known in the art. The mounting member and bottom sled include a bottom portion having the same contour or a substantially similar contour to the contour of the bottom portion of the flashlight body. Additionally, the method may further include providing a ring at a rear portion of the formed flashlight body.

While the invention has been described with respect to certain preferred embodiments, it is to be understood that the invention is capable of numerous changes, modifications, and rearrangements without departing from the scope or spirit of the invention as defined in the claims.

We claim:

1. An underwater illumination system comprising:

a glove having an interior, an inner surface, and an outer surface;

an underwater flashlight including a LED illumination source;

a power source electrically coupled to said LED illumination source;

a solid body encapsulating the power source and at least a portion of the LED illumination source; and a securing member for connecting said underwater flashlight to said glove, wherein said securing member further comprises a bottom sled and a mounted member, wherein said bottom sled and said mounting member releasably mate into a mounted position wherein said bottom sled and said mounting member are in a fixed position relative to said glove.

2. The underwater illumination system of claim 1 wherein the bottom sled is disposed within the interior of the glove and abuts a portion of the inner surface of the glove when in the mounted position, and wherein said mounted member is disposed over a portion of the outer surface of said glove in said mounting position.

3. The flashlight of claim 2 wherein said bottom sled includes at least one embossment which mates with a corresponding aperture in said mounting member such that an intervening portion of said glove is maintained between said bottom sled and said mounting member when said bottom sled and said mounting member are mated with one another.

4. The flashlight of claim 1 wherein said mounting member includes at least two clip members for maintaining said flashlight over a top portion of said mounting member and between said clip members.

* * * * *